US005110090A

United States Patent [19]

McDuffie

[11] Patent Number: 5,110,090

[45] Date of Patent: May 5, 1992

[54] HYDRAULIC LIFTING DEVICE

[76] Inventor: William L. McDuffie, P.O. Box 201, Oak Ridge, La. 71264

[21] Appl. No.: 660,041

[22] Filed: Feb. 25, 1991

[51] Int. Cl.[5] ..... E21B 19/00

[52] U.S. Cl. ..... 254/124; 254/134

[58] Field of Search ..... 254/124, 133, 134, 30-31, 254/DIG. 1

[56] References Cited

U.S. PATENT DOCUMENTS

| | | | |
|---|---|---|---|
| 1,292,823 | 1/1919 | Livesay | 254/133 R |
| 2,852,229 | 9/1958 | Grass | 254/134 |
| 3,028,145 | 4/1962 | Brand | 254/134 |
| 4,068,826 | 1/1978 | Scott | 254/134 |
| 4,256,286 | 3/1981 | Hudgins | 254/30 |

*Primary Examiner*—Robert C. Watson
*Attorney, Agent, or Firm*—John M. Harrison

[57] ABSTRACT

A hydraulic lifting device for sequentially lifting the respective support frames, axles and wheels of a wheeled irrigation system, in order to pivot the wheels in a transverse or longitudinal orientation with respect to the respective axles for deploying the irrigation system in a field. The hydraulic lifting device includes an upward-standing support frame adapted for attachment to the three-point support system of a tractor, a carriage attached to the support frame in vertically sliding relationship, a hydraulic cylinder mounted on the support frame and carriage for raising and lowering the carriage with respect to the support frame, upper and lower lifting member sleeves secured to the carriage and a detachable lifting member carried by the lifting member sleeves for engaging the respective axles and raising and lowering the axles and wheels.

3 Claims, 2 Drawing Sheets

FIG. 1
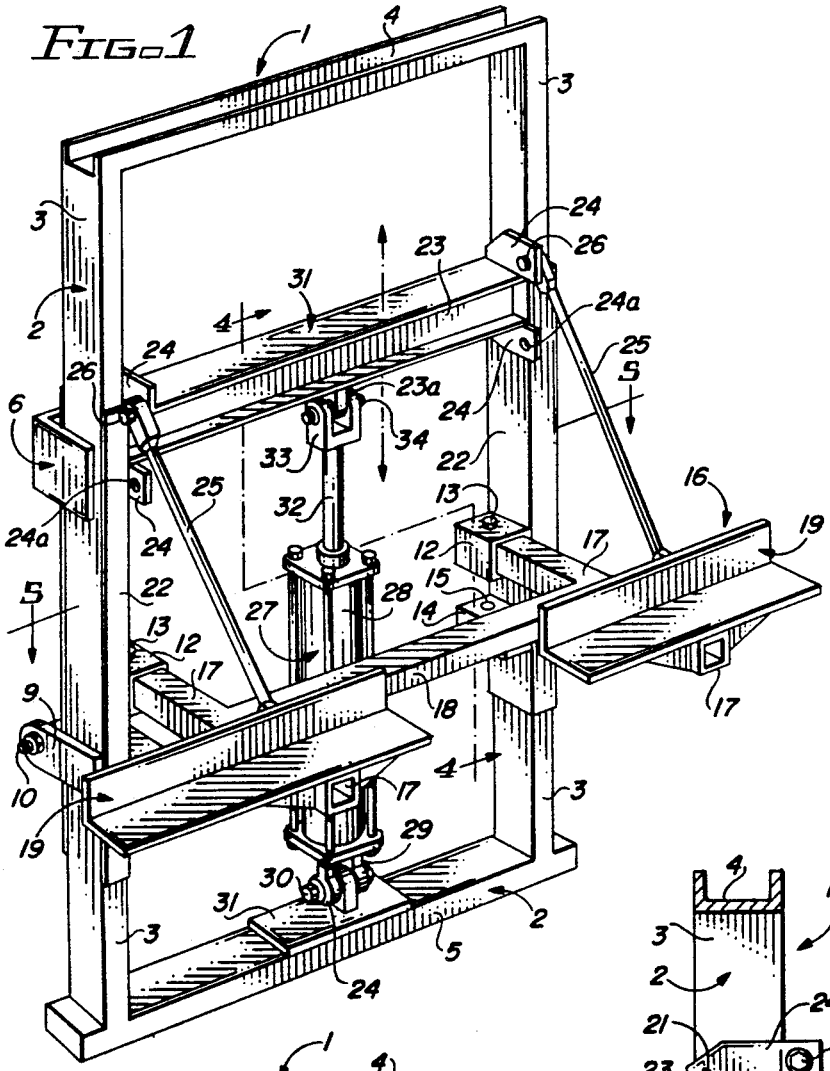
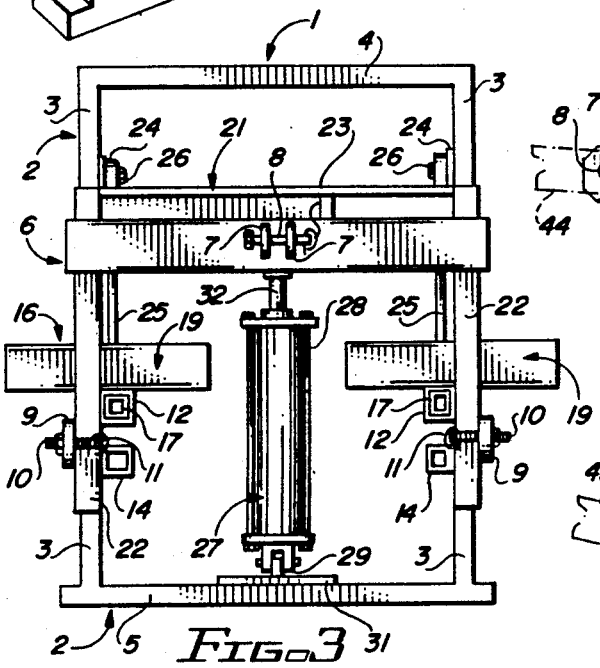
FIG. 3
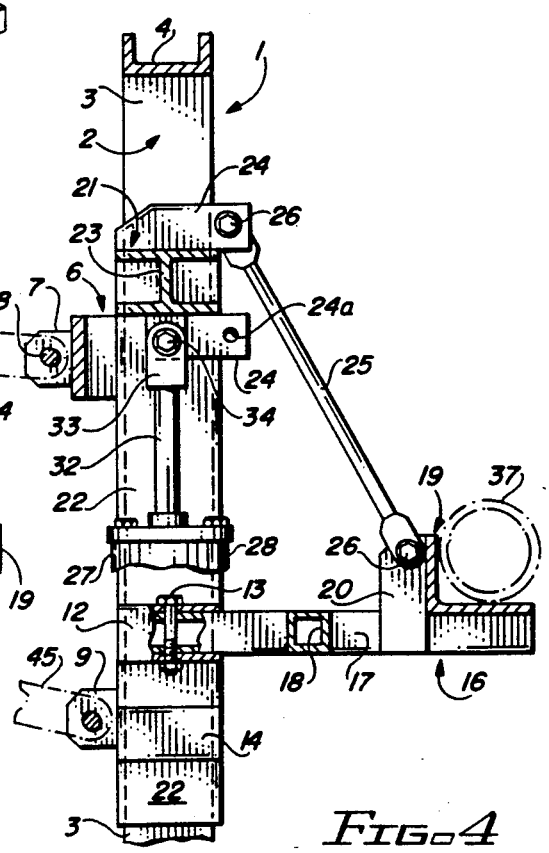
FIG. 4

FIG. 2
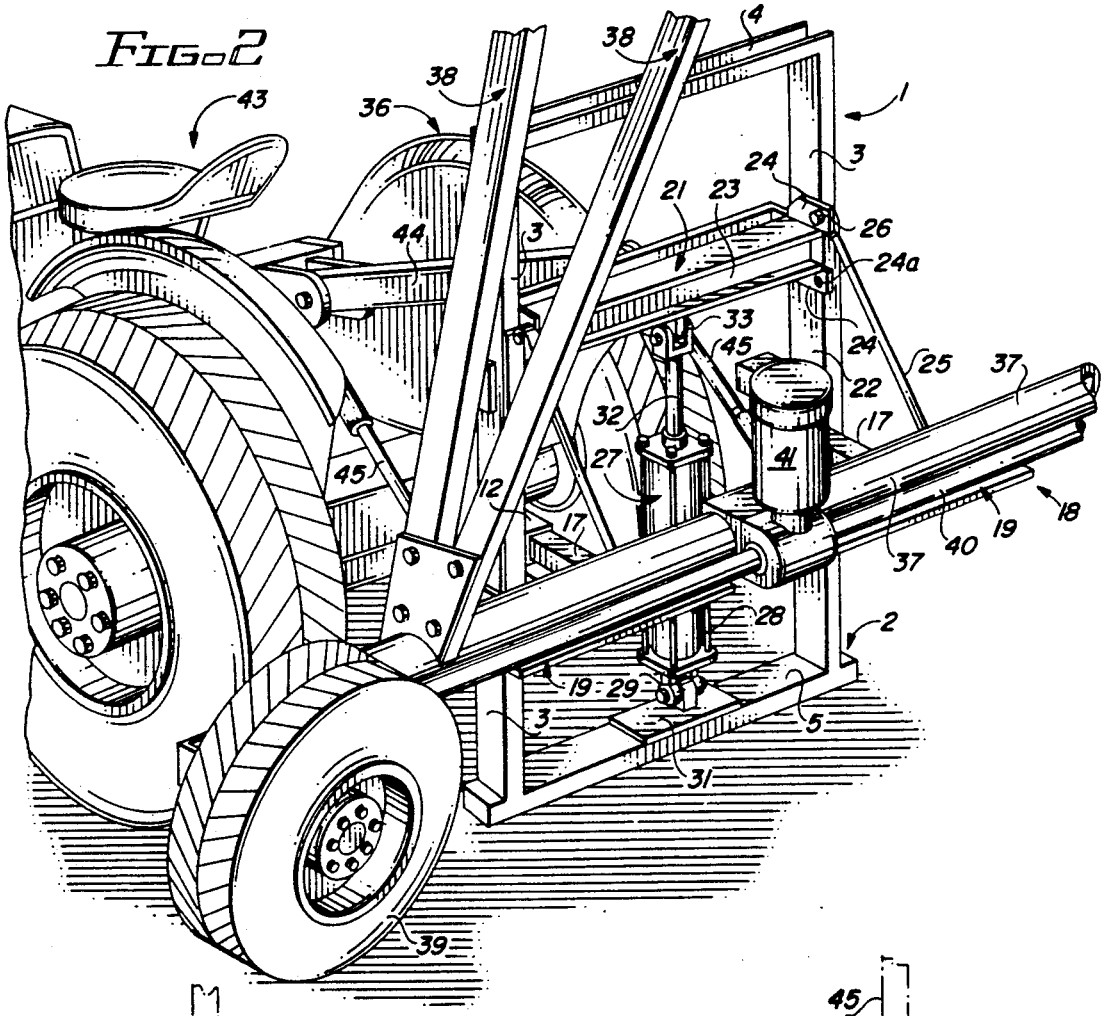
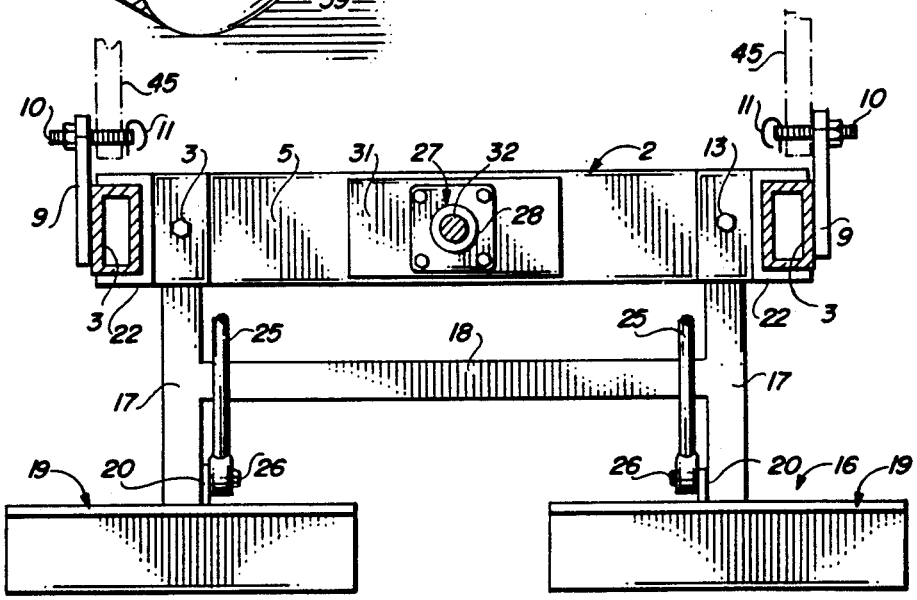
FIG. 5

HYDRAULIC LIFTING DEVICE

BACKGROUND OF THE INVENTION

1. Field of the Invention

This invention relates to wheeled irrigation systems having multiple wheeled frames and more particularly, to a hydraulic lifting device for mounting on the three-point attachment system of a vehicle such as a tractor and deployment in the field for raising the axles of the wheeled frames and pivoting the wheels in a transverse or longitudinal configuration with respect to the axles, respectively. In a preferred embodiment the hydraulic lifting device includes a tractor-mounted, vertically-oriented support frame which slidably supports a carriage fitted with upper and lower lifting member sleeves for removable receiving a lifting member designed to engage the respective axles of the irrigation system frame for lifting purposes. A hydraulic cylinder is mounted in the support frame with the piston attached to the carriage and the cylinder operates the carriage with respect to the frame for raising and lowering the lifting member and hence, the respective irrigation frame axles and wheels. The support frame may be quickly and easily attached to the three-point hook-up on a tractor and moved into the field for quick and easy engagement with the respective axles of the irrigation frame to effect sequential lifting and facilitate pivoting of the wheels with a minimum of effort in a short time.

2. Description of the Prior Art

Various types of hydraulic lift mechanisms are well known in the art. A "Hydraulic Lift Truck" is detailed in U.S. Pat. No. 2,163,675, dated Jun. 27, 1939, to P. D. Germond. The lift truck is fitted with a hydraulic cylinder and wheels for rolling beneath a vehicle and lifting the vehicle to a desired height. A "Tractor Jack" is detailed in U.S. Pat. No. 2,250,964, dated Jul. 29, 1941, to T. W. Poor, et al. The tractor jack includes a jack frame adapted for mounting on the frame of the tractor at the front and rear wheel areas for simultaneously jacking both the front and rear wheels by manipulation of the three-point attachment of the tractor. U.S. Pat. No. 2,375,970, dated May 15, 1945, to W. W. Williams, Jr., details a "Hydraulic Drawbar Lift for Tractors". The hydraulic drawbar includes a pivot drawbar that is raised or lowered by means of a hydraulic ram mechanism connected by a system of levers to the drawbar. The pump of the ram mechanism is operated by an electric motor carried by the casing of the mechanism and the motor is energized by current from the standard storage battery of the electrical system in the tractor. Another "Tractor Jack" is detailed in U.S. Pat. No. 2,712,431, dated Jul. 5, 1955, to G. W. Findley. The tractor jack includes a jack frame attached to the three-point attachment of the tractor and arranged such that either the front or rear end of the tractor can be selectively elevated by operation of the three-point hydraulic attachment. U.S. Pat. No. 3,549,125, dated Dec. 22, 1970, to David Hamilton, details an "Extension Frame for Hydraulic Jacks". The extension frame is suitable for lifting trailers and includes an elongated housing containing a telescopically extensible tube. The tube includes a supporting leg in one end and a base at the other end, to the latter of which the jack is secured by bolts. A stationary rod is mounted in the housing and serves as a guide for a coiled spring surrounding the stationary rod. The coiled spring is compressed when the jack is actuated and urges the extensible tube into the housing when jacking pressure is released.

It is an object of this invention to provide a lifting device which is capable of being removably attached to a vehicle such as a pickup truck or a tractor and moved into the field for various lifting purposes, such as raising the respective axles and wheels of a wheeled irrigation system to facilitate pivoting of the wheels into a longitudinal or transverse configuration with respect to the axles.

Another object of the invention is to provide a hydraulic lifting device which is designed for attachment to the conventional three-point hook-up on a tractor for transportation to the field and is fitted with a removable lifting member for engaging the respective axles of a wheeled irrigation support frame and raising the axles and wheels to facilitate elevation and pivoting of the respective wheels into a longitudinal or transverse configuration with respect to the axles.

Yet another object of this invention is to provide a cylinder-operated lifting device which is characterized by an upward-standing support frame, a carriage vertically and slidably mounted in the support frame, a fluid-operated cylinder connected to the support frame and carriage and at least one set of lifting member sleeves adapted for removably receiving a lifting member designed to engage the respective axles of a wheeled irrigation support frame and raise the axles and connected wheels to facilitate pivoting of the wheels into a transverse or longitudinal configuration with respect to the axles.

A still further object of this invention is to provide a hydraulic lifting device for mounting on the three-point attachment of a tractor, which hydraulic lifting device is characterized by a vertical support frame, a carriage slidably mounted in vertical relationship on the support frame and fitted with upper and lower lifting member sleeves for receving a removable lifting member and a hydraulic cylinder mounted on the support frame with the cylinder piston connected to the carriage, for raising and lowering the carriage and the lifting member to, in turn, raise and lower the respective axles of a wheeled irrigation support and facilitate selective rotation of the wheels attached to the axles into a transverse or longitudinal configuration with respect to the axles.

SUMMARY OF THE INVENTION

These and other objects of the invention are to provide a new and improved hydraulic lifting device which, in a preferred embodiment, includes an upward-standing, rectangular support frame fitted with a three-point attachment bracket system for attachment to the three-point connection apparatus of a tractor for transportation purposes, a carriage vertically and slidably adjustable within the support frame by means of a hydraulic cylinder, upper and lower member sleeves attached to the carriage for selectively receiving a removable lifting member fitted with spacer plates for engaging the respective axles of a wheeled irrigation system and lifting the axles to facilitate rotation of the wheels attached to each end of the axles into a transverse or longitudinal configuration with respect to the axles.

BRIEF DESCRIPTION OF THE DRAWINGS

The invention will be better understood by reference to the accompanying drawings, wherein:

FIG. 1 is a perspective view of a preferred embodiment of the hydraulic lifting device of this invention;

FIG. 2 is a perspective view of the hydraulic lifting device mounted on the three-point connection of a tractor and positioned to lift an axle and wheel of a wheeled irrigation system frame;

FIG. 3 is a rear view of the hydraulic lifting device;

FIG. 4 is a vertical sectional view of the carriage element taken along line 4—4 of the hydraulic lifting device illustrated in FIG. 1; and FIG. 5 is a horizontal sectional view of carriage and frame elements taken along line 5—5 of the hydraulic lifting device illustrated in FIG. 1;

DESCRIPTION OF THE PREFERRED EMBODIMENTS

Referring initially to FIGS. 1, 3, 4 and 5 of the drawings, the hydraulic lifting device of this invention is generally illustrated by reference numeral 1. The hydraulic lifting device 1 is characterized by a vertically-oriented, rectangular-shaped support frame 2, defined by a pair of spaced vertical support frame members 3, which are spanned and connected by a horizontal top support frame member 4 and a base support member 5. A horizontal support frame stiffener 6 also spans the support frame 2 and is welded to each of the vertical support frame members 3 at spaced points located intermediate the top support frame member 4 and the base support member 5, as illustrated. A pair of top tractor mount plates 7 are welded to the approximate center of the support frame stiffener 6 and are fitted with registering horizontal openings (not illustrated) for receiving a top tractor mount pin 8, as further illustrated in FIGS. 3 and 4. A pair of bottom tractor mount plates 9 extend in spaced, oppositely-disposed relationship from welded attachment to the parallel vertical support frame members 3 below the top tractor mount plates 7, as further illustrated in FIGS. 3 and 4 and a corresponding pair of bottom tractor mount pins 10 are inserted in horizontal openings (not illustrated) provided in the bottom tractor mount brackets 9. Retaining clips 11 are inserted through holes (not illustrated) provided in the ends of the top tractor mount pin 8 and bottom tractor mount pins 10, respectively, for security purposes, as illustrated in FIG. 3. A lifting member carriage is generally illustrated by reference numeral 21 and is disposed in alignment with the support frame 2 between the vertical support frame members 3, in vertically-sliding relationship. The lifting member carriage 21 is characterized by a pair of spaced carriage channels 22, which receive each of the vertical support frame members 3 in sliding relationship, as illustrated in FIGS. 1 and 5 and are joined at the top by a carriage cross-member 23, provided with a center-located, downwardly-extending cross-member bracket 23*a*. A pair of spaced upper lifting member sleeves 12 are welded in transverse relationship to the carriage channels 22 and are provided with vertical sleeve openings 15, which receive companion sleeve bolts 13, as further illustrated in FIGS. 1, 3 and 4. A pair of spaced lower lifting member sleeves 14 are also welded to the carriage channels 22 beneath the upper lifting member sleeves 12, respectively, and are also fitted with vertical sleeve openings 15 for alternatively receiving the sleeve bolts 13. A lifting member is generally illustrated by reference numeral 16 and projects horizontally from the opposite side of the lifting member carriage 21 from the top tractor mount plates 7 and bottom tractor mount plates 9. The lifting member 16 is characterized by a pair of spaced, parallel lifting arms 17, connected by a lifting arm spacer 18, which is fitted with a pair of outwardly-extending, angle-iron spacer plates 19, as illustrated in FIGS. 1 and 3-5. The ends of the lifting arms 17 opposite the spacer plates 19 are selectively inserted into cooperating horizontally-spaced pairs of the upper lifting member sleeves 12 or the lower lifting members 14, to removably mount the lifting member 16 on the vertically-slidable lifting member carriage 21 at a desired height above the base support frame member 5, as further illustrated in FIG. 4. For example, as further illustrated in FIG. 4, the projecting ends of the lifting arms 17 are slidably inserted in the upper lifting member sleeves 12, respectively, and a pair of sleeve bolts 13 are extended through the vertical registering sleeve openings 15, provided in the upper lifting member sleeves 12 and corresponding openings (not illustrated) in the lifting arms 17, respectively, in order to removably secure the lifting member 16 on the lifting member carriage 21. Corresponding ends of a pair of spaced support rods 25 are secured to spaced arm spacer brackets 20, attached to the lifting arm spacer 18, respectively, and the opposite, or upper ends of the support rods 25 are each fitted with a knuckle and are removably attached to the upper pair of two pairs of spaced cross-member plates 24, welded to the carriage cross-member 23, by means of support rod bolts 26. The support bolts 26 extend through registering plate openings 24*a*, located in the cross-member plates 24 and the knuckles of the support rods 25, respectively, as well as openings in the respective arm spacer brackets 20, to removably secure the upper and lower ends of the support rods 25. Accordingly, it will be appreciated from a consideration of FIGS. 1 and 4 that the lifting member 16 can be quickly and easily installed on and removed from the lifting member carriage 21 by inserting and removing the respective sleeve bolts 13 and upper ones of the support rod bolts 26, respectively.

A hydraulic cylinder 27 is vertically disposed between the base support member 5 of the support frame 2 and the carriage cross-member 23 of the lifting member carriage 21. The cylinder housing 28 of the hydraulic cylinder 27 is secured to the base support frame member 5 by means of a cylinder housing bracket mount 31, which is welded to the base support frame member 5 and receives a cylinder housing clevis 29 by means of a cylinder housing clevis pin 30, as illustrated in FIGS. 1 and 3. The upwardly-extending cylinder piston 32 is attached to the downwardly-extending cross-member bracket 23*a*, which is welded to the carriage cross-member 23, by means of a cylinder piston clevis 33 and a cooperating cylinder piston clevis pin 34, as further illustrated in FIGS. 1 and 4.

In operation, referring now to FIG. 2 of the drawings, the hydraulic lifting device 1 is attached to the top tractor mount rod 44 and spaced bottom tractor mount rods 45 of the conventional 3-point attachment system of a tractor 43, by extending the top tractor mount rod 44 between the top tractor mount plates 7 and inserting the top tractor mount bracket pin 8 through the registering openings (not illustrated) therein. The bottom tractor mount rods 45 are attached to the spaced bottom tractor mount plates 9 in similar fashion, using the respective bottom tractor mount pins 10. The spaced lifting arms 17 are then slidably extended in the appropriate upper lifting member sleeves 12 or lower lifting member sleeves 14 and secured in place by the sleeve bolts 13, as heretofore described. The hydraulic lifting device 1 is then moved into the field by operation of the tractor 43 and is backed into operating position, such that the base support frame member 5 is resting on the ground and the horizontally-oriented bottom flange elements of the spacer plates 19 are inserted beneath the axle 37 of the irrigation frame 38 of a wheeled irrigation system 36, on each side of the drive shaft motor 41 and spaced from the wheels 39, as further illustrated in FIG. 2. The hydraulic cylinder 27 is then actuated by pumping hydraulic fluid from the tractor 43 through conventional hydraulic hoses (not illustrated) which are attached to the three-point tractor hydraulic system (not illustrated), to raise the cylinder piston 32 with respect to the cylinder housing 28 and cause the lifting member carriage 21 and the lifting member 16 to move upwardly in concert, thereby lifting the axle 37 and the wheels 39. The wheels 39 can then be manipulated and pivoted in either the transverse or longitudinal configuration with respect to the axle 37, as deemed necessary. After the wheels 39 are thus adjusted, pressure is released from the hydraulic cylinder 27 to allow retraction of the cylinder piston 32 and lowering of the lifting member carriage 21, lifting member 16, axle 37 and wheels 39 in concert. This action facilitates movement of the hydraulic lifting device 1 into an alternative position by operation of the tractor 43 to lift and pivotally adjust another set of wheels 39. The procedure is completed throughout the spaced sets of irrigation frames 38 of the wheeled irrigation system 36, until each wheel 39 is adjusted in the desired configuration.

It will be appreciated by those skilled in the art that the hydraulic lifting device of this invention is characterized by convenience and ease of operation with minimum labor, since it can be rapidly moved from location to location at the respective irrigation frames 38 in the wheeled irrigation system 36 by means of the tractor 43. It will be further appreciated by those skilled in the art that the differences in diameter of the wheels 39 in the respective wheeled irrigation systems 36 can be accommodated by inserting the parallel lifting arms 17 of the lifting member 16 in either the upper lifting member sleeves 12, to accommodate larger wheels 39, or in the case of smaller wheels 39, in the lower lifting member sleeves 14, as desired. Moreover, the generous width and length of the bottom, horizontal flange element of the dual spacer plates 19 support the axle 37 sufficiently to prevent bending of the axle 37 beyond its elastic limit. It is understood that a single spacer plate 19 which extends along the entire length of the lifting arm spacer 18 may be used in place of the dual spacer plates 19 under circumstances where the hydraulic lifting device 1 is constructed to fit between the drive shaft motor 41 and each wheel 39, to lift the wheels 39 independently of each other.

It is further understood that an air or alternative fluid-operated cylinder may be substituted for the hydraulic cylinder 27, according to the knowledge of those skilled in the art. However, since the hydraulic cylinder 27 may be easily attached to the hydraulic system of the tractor 43 by means of hydraulic hoses (not illustrated) and the hydraulic system of the tractor 43 then conveniently used, the hydraulic cylinder 27 is preferred. Furthermore, while a preferred vehicle for mounting and transporting the hydraulic lifting device 1 is the tractor 43, it will be appreciated that the hydraulic lifting device 1 can be similarly mounted on the back of a pick-up truck or other vehicle, according to the knowledge of those skilled in the art.

While the preferred embodiments of the invention have been described above, it will be recognized and understood that various modifications may be made in the invention and the appended claims are intended to cover all such modifications which may fall within the spirit and scope of the invention.

Having described my in ention with the particularity set forth above, what is claimed is:

1. A lifting device for mounting on a vehicle and engaging and lifting an object, comprising a generally rectangularly-shaped support frame having the largest dimension located substantially in a vertical plane and stiffener means carried by said support frame in substantially horizontal relationship between the top and bottom of said support frame, said support frame adapted for attachment to the vehicle; a carriage characterized by a pair of carriage channels slidably disposed in said support frame in vertical orientation, at least one pair of sleeves carried by said carriage channels in spaced, transverse relationship and a carriage cross member connecting said carriage channels for maintaining said carriage channels in said support frame; a pair of lifting arms adapted for engaging said sleeves, respectively, in spaced, substantially horizontal relationship; a lifting arm spacer carried by said lifting arms in fixed relationship; a pair of spacer plates attached to said lifting arms, respectively, for engaging the object responsive to operation of the tractor; and a hydraulic cylinder having a bottom end attached to the bottom of said support frame and a piston carried by said cylinder in extensible and retractable relationship, said piston attached to said carriage-cross member for raising and lowering said carriage and said lifting arms, said lifting arm spacer, said spacer plates and the object in concert, responsive to operation of said hydraulic cylinder.

2. The lifting device of claim 1 wherein said at least one pair of sleeves further comprises two sets of sleeves disposed in vertically spaced relationship for selectively receiving said lifting arms.

3. A hydraulic lifting device for mounting on the three-point connection of a tractor and sequentially engaging and lifting the axles and wheels of a wheeled irrigation system, said hydraulic lifting device comprising a support frame carried by the three-point connection in substantially vertical relationship; a carriage vertically and slidably mounted inside said support frame; a hydraulic cylinder having a cylinder housing attached to the bottom of said support frame and a piston carried by said cylinder housing, with the free end of said pistonattached to said carriage; two pairs of sleeves carried by said carriage in vertically spaced relationship; a pair of lifting arms adapted for engaging selected pairs of said sleeves in spaced relationship, respectively; a a spacer carried by said lifting arms in fixed relationship; a pair of spacer plates attached to said lifting arms, respectively, for engaging the object responsive to operation of the tractor; and a pair of horizontal engaging plates attached to said lifting arms, respectively, for engaging the axles and wheels responsive to operation of the vehicle and selectively raising and lowering said carriage, said lifting arms and the axles and wheels, respectively, in concert responsive to operation of said hydraulic cylinder.

* * * * *